US010791786B2

(12) United States Patent
Booher, Sr. et al.

(10) Patent No.: US 10,791,786 B2
(45) **Date of Patent: *Oct. 6, 2020**

(54) ENERGY ABSORBING FOOTBALL HELMET

(71) Applicants: Benjamin V. Booher, Sr., Scottsdale, AZ (US); Benjamin V. Booher, Jr., Scottsdale, AZ (US)

(72) Inventors: Benjamin V. Booher, Sr., Scottsdale, AZ (US); Benjamin V. Booher, Jr., Scottsdale, AZ (US)

( * ) Notice: Subject to any disclaimer, the term of this patent is extended or adjusted under 35 U.S.C. 154(b) by 152 days.

This patent is subject to a terminal disclaimer.

(21) Appl. No.: 16/160,561

(22) Filed: Oct. 15, 2018

(65) Prior Publication Data

US 2019/0045869 A1 Feb. 14, 2019

Related U.S. Application Data

(63) Continuation of application No. 15/215,528, filed on Jul. 20, 2016, now Pat. No. 10,098,402.

(60) Provisional application No. 62/255,212, filed on Nov. 13, 2015.

(51) Int. Cl.

| | |
|---|---|
| ***A42B 3/06*** | (2006.01) |
| ***A42B 3/08*** | (2006.01) |
| ***A42B 3/12*** | (2006.01) |
| ***A42B 3/16*** | (2006.01) |
| ***A42B 3/20*** | (2006.01) |
| ***A42B 3/22*** | (2006.01) |

(52) U.S. Cl.

CPC ..... *A42B 3/062* (2013.01); *A42B 3/065* (2013.01); *A42B 3/08* (2013.01); *A42B 3/125* (2013.01); *A42B 3/16* (2013.01); *A42B 3/20* (2013.01); *A42B 3/22* (2013.01)

(58) Field of Classification Search

USPC ..... 2/411, 418, 425

See application file for complete search history.

(56) References Cited

U.S. PATENT DOCUMENTS

| | | | |
|---|---|---|---|
| 3,315,273 | A | 4/1967 | Bullard |
| 3,423,758 | A | 1/1969 | Heacox |
| 4,141,085 | A | 2/1979 | Adams, Sr. |
| 4,168,542 | A | 9/1979 | Small |
| 4,845,786 | A | 7/1989 | Chiarella |

(Continued)

FOREIGN PATENT DOCUMENTS

WO 2013188467 A2 12/2013

OTHER PUBLICATIONS

U.S. Receiving Office, International Search Report and Written Opinion of the International Searching Authority in PCT/US2016/061556, dated Dec. 9, 2016, which is an international application that shares the same priority as this U.S. application.

*Primary Examiner* — Katherine M Moran

(74) *Attorney, Agent, or Firm* — Kolitch Romano LLP

(57) ABSTRACT

A football helmet including a one-piece outer shell defining an exterior and an interior. The shell includes a plurality of slots penetrating at least partially through the shell from the exterior to the interior of the shell. Each slot may be disposed adjacent to at least one other slot and each pair of adjacent slots defines an energy absorbing beam portion between the adjacent slots. Each beam portion is configured to deform and absorb energy when the exterior of the shell is impacted from a normal direction.

17 Claims, 4 Drawing Sheets

(56) References Cited

U.S. PATENT DOCUMENTS

| | | | | |
|---|---|---|---|---|
| 5,269,026 | A | 12/1993 | Mcmanus | |
| 5,271,103 | A | 12/1993 | Darnell | |
| 5,829,065 | A | 11/1998 | Cahill | |
| 5,887,289 | A * | 3/1999 | Theoret | A42B 1/08 2/195.1 |
| 6,065,159 | A | 5/2000 | Hirsh | |
| 6,070,271 | A | 6/2000 | Williams | |
| 6,154,889 | A | 12/2000 | Moore, III et al. | |
| 6,550,071 | B2 | 4/2003 | Garneau | |
| 7,089,602 | B2 | 8/2006 | Talluri | |
| 9,314,063 | B2 | 4/2016 | Bologna et al. | |
| 9,439,468 | B1 | 9/2016 | Blagg et al. | |
| 10,098,402 | B2 * | 10/2018 | Booher, Sr. | A42B 3/062 |
| 10,376,010 | B2 * | 8/2019 | Allen | A42B 3/32 |
| 2002/0023291 | A1 | 2/2002 | Mendoza | |
| 2012/0317705 | A1 | 12/2012 | Lindsay | |
| 2013/0305435 | A1 | 11/2013 | Surabhi | |
| 2013/0340146 | A1 | 12/2013 | Dekker et al. | |
| 2014/0215694 | A1 * | 8/2014 | Grice | A42B 3/06 2/411 |
| 2014/0325745 | A1 * | 11/2014 | Erb | A42B 3/127 2/414 |
| 2015/0089724 | A1 * | 4/2015 | Berry | A42B 3/064 2/414 |
| 2015/0164173 | A1 | 6/2015 | West | |
| 2016/0000168 | A1 * | 1/2016 | Allen | A42B 3/08 2/414 |
| 2018/0125143 | A1 * | 5/2018 | Herbert | A42B 3/06 |

* cited by examiner

ENERGY ABSORBING FOOTBALL HELMET

FIELD

This disclosure relates to football helmets with increased energy absorbing capabilities. More specifically, the disclosed embodiments relate to football helmets including energy absorbing beams disposed between a plurality of slots formed in the outer shell of the helmet.

INTRODUCTION

American football, which is one of the country's favorite pastimes, is also one of the most dangerous. The sport is characterized by high energy tackles and collisions that are conducive to a number of serious injuries, including mild to severe concussions and traumatic brain injury. In 2012, the National Football League (NFL) experienced a total of 189 concussions during its regular season, translating to more than 11 concussions each week.

Similarly, college football players experience an average of 2.5 concussions for every 1,000 game-related exposures, while 25,000 players between the ages of eight and nineteen are taken to emergency rooms for concussions each year. With the rates of these head injuries either increasing or stabilizing over the past 50 years, many health experts have started referring to a football-related "concussion epidemic." At the same time, the long-term consequences of head trauma experienced by football players have come under increasing scrutiny in recent years.

In the case of American football, while many attempts have been made to improve the design and safety of the players' helmets, the number of severe brain and other injuries continues to rise with participation in the sport, and with the increasing speed and power of the athletes. The hard outer shell of existing helmets frequently does little to absorb initial impact forces, and merely transfers the impact energy of collisions to the inner cushioning of the helmets. Accordingly, new and improved helmet designs are needed, in which the outer shell will more effectively absorb the energy of an impact.

SUMMARY

In some embodiments, a football helmet according to the present teachings may include a one-piece outer shell defining an exterior and an interior. The shell may include a crown portion defining an upper region of the shell and a front portion extending generally forward and downward from the crown portion. The shell may include left and right side portions extending generally downward and laterally from the crown portion sufficiently to cover a respective left or right ear of a football player wearing the helmet and a rear portion extending generally rearward and downward from the crown portion. The shell may include a plurality of slots formed in the shell and penetrating at least partially through the shell from the exterior to the interior of the shell. Each slot may be disposed adjacent to at least one other slot and each pair of adjacent slots may define an energy absorbing beam portion between the adjacent slots. Each beam portion may be configured to deform and absorb energy to a greater extent than in the absence of the beam portion, when the exterior of the shell is impacted from a normal direction.

In some embodiments, a helmet configured to be worn by a football player while playing football may include a crown portion defining an upper region of the helmet and a front portion extending generally forward and downward from the crown portion. The helmet may further include left and right side portions extending generally downward and laterally from the crown portion sufficiently to cover a respective left or right ear of a football player wearing the helmet and a rear portion extending generally rearward and downward from the crown portion. The helmet may include a plurality of slots formed in the shell and extending along the shell without reaching an edge of the shell. Each slot may penetrate at least partially through the shell from an exterior to an interior of the shell and each slot may be disposed adjacent to and generally parallel with at least one other slot. Each pair of adjacent slots may define an energy absorbing beam portion between the adjacent slots. Each beam portion may be configured to deform and absorb energy to a greater extent than in the absence of the beam portion when the exterior of the shell is impacted from a normal direction.

In some embodiments, a helmet configured to be worn by a football player while playing football may include a crown portion and a front portion extending generally forward and downward from the crown portion. The helmet may include left and right side portions extending generally downward and laterally from the crown portion and a rear portion extending generally rearward and downward from the crown portion. The helmet may further include a plurality of pairs of adjacent and generally parallel slots penetrating at least partially from an exterior to an interior of the helmet. Each pair of adjacent slots may define a beam portion configured to absorb energy to a greater extent than in the absence of the slots when the exterior of the helmet is impacted.

The present disclosure provides various apparatuses and methods of use thereof. Features, functions, and advantages may be achieved independently in various embodiments of the present disclosure, or may be combined in yet other embodiments, further details of which can be seen with reference to the following description and drawings.

DESCRIPTION

Overview

Various embodiments of a football helmet having energy absorbing beams between adjacent slots in the outer shell are described below and illustrated in the associated drawings. Unless otherwise specified, a football helmet and/or its various components may, but are not required to, contain at least one of the structure, components, functionality, and/or variations described, illustrated, and/or incorporated herein. Furthermore, the structures, components, functionalities, and/or variations described, illustrated, and/or incorporated herein in connection with the present teachings may, but are not required to, be included in other protective helmets. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

EXAMPLES, COMPONENTS, AND ALTERNATIVES

The following sections describe selected aspects of exemplary football helmets as well as related systems and/or methods. The examples in these sections are intended for illustration and should not be interpreted as limiting the entire scope of the present disclosure. Each section may include one or more distinct inventions, and/or contextual or related information, function, and/or structure.

Example 1

Figure 1:
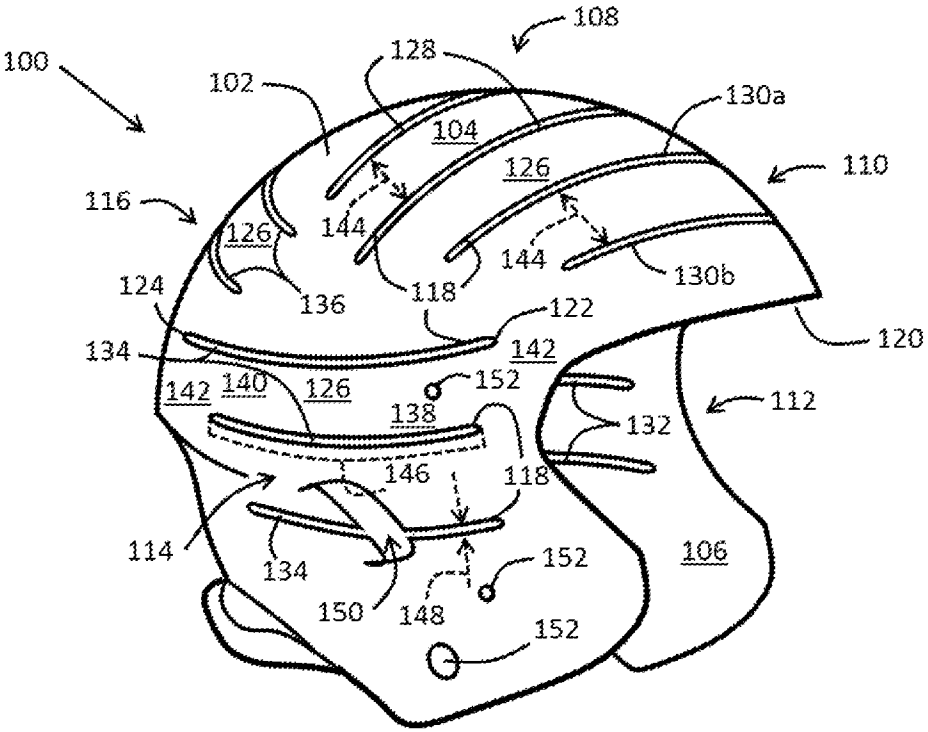
FIG. 1 is a front perspective view of an exemplary embodiment of an outer shell of a football helmet, according to aspects of the present teachings.

This example describes an illustrative football helmet according to aspects of the present disclosure; see FIG. 1.

FIG. 1 is a front perspective view of an exemplary embodiment of a football helmet, generally indicated at 100. Football helmet 100 may be configured to be worn by a football player while playing football. Helmet 100 may include a one-piece outer shell 102 defining an exterior 104 and an interior 106. The helmet may include other components, such as one or more interior padding or cushioning layers, a face mask, a visor, a chinstrap, and various elements to attach these components together. These other components are not shown in the drawings, may take any appropriate shape or configuration, and may be made of any appropriate materials.

One-piece outer shell 102 includes a crown portion generally indicated at 108, defining an upper region of the shell and/or helmet 100. Shell 102 further includes a front portion generally indicated at 110, extending generally forward and downward from crown portion 108, a left side portion generally indicated at 112, and a right side portion generally indicated at 114. The left and right side portions extend generally downward and laterally from crown portion 108 sufficiently to cover a respective left or right ear of a football player wearing the helmet. Shell 102 further includes a rear portion generally indicated at 116, extending generally rearward and downward from the crown portion.

Football helmet 100 includes a plurality of slots 118 formed in shell 102 and penetrating at least partially through the shell from the exterior 104 to the interior 106 of the shell. Each of the plurality of slots extends along the shell without reaching an edge 120 of the shell. That is, each slot has a first slot end 122 and a second slot end 124, with both the first and second slot ends spaced apart from edge 120 of the shell. Edge 120 of the shell may also be an edge portion of helmet 100. In other embodiments, some of the slots formed in the helmet shell may extend closer to an edge of the shell, or even all the way to an edge of the shell.

Each slot 118 is disposed adjacent to at least one other slot, and each slot is generally parallel with at least one other slot. Each pair of adjacent slots defines an energy absorbing beam portion 126 between the adjacent slots. Each beam portion 126 is configured to deform and absorb energy to a greater extent than in the absence of the beam portion and/or the slots 118 when the exterior 104 of the shell 102 is impacted from a normal direction. That is, a beam portion 126 may flex and absorb energy much as a spring may absorb energy when compressed or extended. An outer shell of a helmet including a plurality of slots thus may absorb more energy than a similarly configured outer shell of a helmet that does not include a plurality of slots. Absorbing energy in the outer shell may reduce forces acting on an interior liner of the helmet, which may better manage deceleration of the player's head, thereby reducing concussions and other injuries.

In the embodiment of FIG. 1, the plurality of slots 118 includes a first plurality 128 disposed in the crown portion 108, a second plurality 130 disposed in the front portion, a third plurality 132 disposed in the left side portion 112, a fourth plurality 134 disposed in the ride side portion 114, and a fifth plurality 136 disposed in the rear portion 116. The first plurality 128 includes two slots disposed within the crown portion of the shell. The second plurality 130 includes two slots disposed within the front portion of the shell. The third plurality 132 include three slots disposed within the left side portion of the shell, two of which are visible in FIG. 1. The fourth plurality 134 also includes three slots disposed within the right side portion of the shell. The fifth plurality 136 includes two slots disposed within the rear portion of the shell. More generally, in other embodiments, any desired number of slots may be disposed in the various portions of the shell, and in some cases there may be no slots disposed in particular portions.

As each slot 118 in FIG. 1 does not extend to the edge 120 of the shell 102, each beam portion 126 has a first beam end 138 and a second beam end 140 with both the first and second beam ends continuous with portions 142 of the shell outside the region between the adjacent pair of slots. That is, the first and second beam ends may be fixed or formed unitarily with the remainder of shell 102. If a beam 126 is considered as a member which may flex or deform to absorb energy, then beam 126 may behave as a member that is fixed at both ends. Such a member may behave differently than a member with one or more free ends, such as a cantilever, as would be the case if the slots defining the beam were to extend to the edge of the shell.

In FIG. 1, each slot 118 in a pair of adjacent slots is substantially parallel to the other slot in the pair. That is, a distance 144 between an adjacent pair of parallel slots, measured along the exterior 104 of the shell, is substantially constant along the length of the slot. Distance 144 may be viewed as a width of the beam portion 126 defined by the pair of adjacent slots. For example, in the embodiment of FIG. 1, the two slots in the first plurality 128 of slots disposed in the crown portion 108 of the shell are substantially parallel to one another. Further, the two slots in the second plurality 130 of slots disposed in the front portion are substantially parallel to one another, even though one of the slots 130*a* has a greater length along slot 130*a* than the other slot 130*b*. In other embodiments, slots may be provided which are not substantially parallel to other slots, while still defining energy absorbing beam portions between adjacent slots.

Each of the plurality of slots 118 in FIG. 1 has a generally constant curvature along its length, corresponding to the curvature of the shell. That is, any curvature of a slot may be due only to the inherent curvature of shell 102, and not to any intentional change in direction made by the slot as it extends along the shell. In other embodiments, slots may be provided with differing curvatures, so that adjacent slots need not always be parallel or substantially parallel. For example, a particular slot may include a first constant-curvature segment joined at an angle to a second constant-curvature segment, to form an approximately V-shaped slot. Similarly, adjacent slots may in general intersect in any desired manner, or take any desired shape.

In FIG. 1, each slot 118 in a pair of adjacent slots is discrete and non-continuous relative to the other slot of the pair. In contrast, the straight sides of a U-shaped slot would not be considered discrete, as the two sides of the U-shaped slot are joined by the curved end of the U-shaped slot. The sides of the U-shaped slot would also not be considered non-continuous, as there would be a continuous path from one side to the other through the curved end of the U-shaped slot. If a first slot is to be considered discrete and non-continuous relative to a second slot, then it must be possible to draw an imaginary closed loop on shell 102 around the first slot that completely encloses the first slot without enclosing any of the second slot, and similarly for the second slot. Although slots 118 in FIG. 1 are all discrete and non-continuous relative to each other, the present teachings also contemplate slots that intersect or are otherwise connected to each other.

Shell 102 may be manufactured utilizing known materials and known processes including various means of material lamination, flow molding, sheet forming, etc. and/or the like. The plurality of slots 118 may be molded, formed or machined in positions including, but not limited to, those shown in FIG. 1. The plurality of slots in the shell may be formed as the shell is being formed, or may be cut or otherwise machined into the shell after the shell has been formed.

The number, position, and shape of slots 118 may vary, with those variations determined by the energy absorbing properties of the arrangement of slots along with deflection and structural considerations. The shape of the slots may include any of a length 146 of the slots, a width 148 of the slots, and a depth of the slots into or through shell 102. Each slot need not have the same length, width, or depth. The arrangement of the plurality of slots may depend on the thickness and mechanical properties of the material from which the shell is produced, and may depend on the contact rules and player experience respective to a wide range of leagues and/or activities.

In some examples, the width 148 of each of the plurality of slots 118 may be in a range of 0.001 to 0.5 inches. In some examples, the length 146 of each of the plurality of slots may be in a range of 1.0 to 15 inches. Each slot may have an aspect ratio, which is a ratio of the length of the slot to the width of the slot, in the range of 10:1 up to 100:1 or more. In some examples, the distance 144 between an adjacent parallel pair of slots may be in a range of 0.1 to 10 inches.

Shell 102 may include other cutouts or molded openings such as one or more hearing ports 150 disposed in the left and right side portions 112 and 114 and one or more attachment points 152 for hardware. The attachment points may be utilized for coupling the shell to any or all of an interior lining, a facemask, a visor, and a chinstrap. In some examples, one or more slots 118 may intersect one or more hearing ports and/or one or more attachment points.

Example 2

Figure 2:
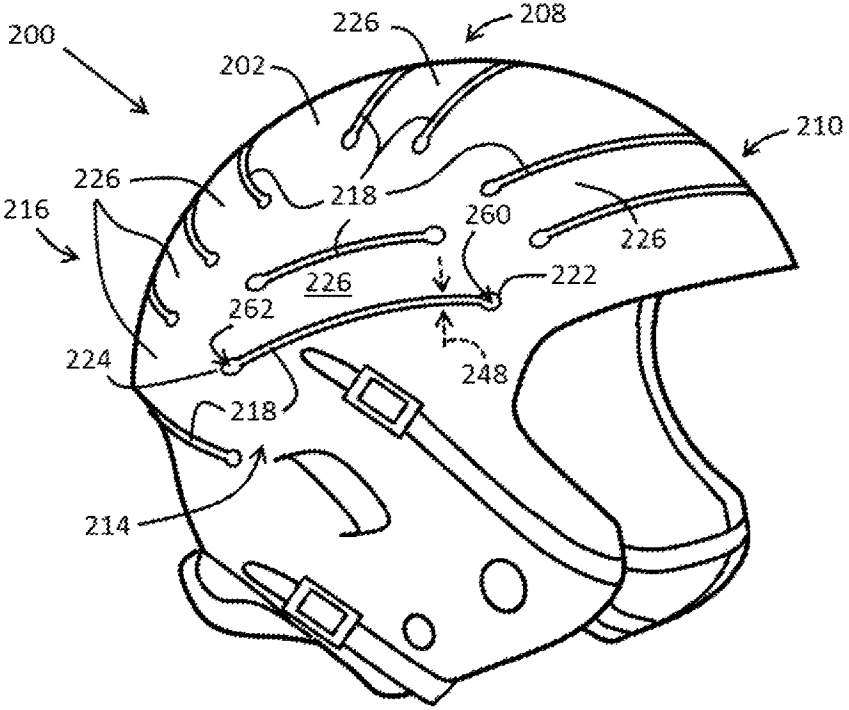
FIG. 2 is a front perspective view of another exemplary embodiment of an outer shell of a football helmet, according to aspects of the present teachings.

This example describes another illustrative football helmet according to aspects of the present teachings; see FIG. 2.

FIG. 2 is a front perspective view of another exemplary embodiment of a football helmet, generally indicated at 200. Helmet 200 may have many similarities with helmet 100 described above, and the discussion of various features and benefits of helmet 100 will not be repeated in its entirety. Similar components and features of helmet 200 and helmet 100 are numbered accordingly. For example, helmet 200 includes a one-piece outer shell 202 that is similar to the one-piece outer shell 102 of helmet 100. Further, shell 202 includes a plurality of slots 218 that are similar in many respects to the plurality of slots 118 in shell 102 of helmet 100. However, as described below, slots 218 include fracture-resisting features not shown in the embodiment of FIG. 1.

Each slot 218 defines a first lateral end portion 260 and a second lateral end portion 262. The first lateral end portion is proximate a first slot end 222 and the second lateral end portion is proximate a second slot end 224. Each of the first and second lateral end portions is rounded to reduce stress fractures of the shell. In addition to this rounding, a width 248 of the slots is slightly increased at the first and second lateral end portions as compared to portions of the slot spaced from the first and second slot ends. The enlarged lateral end portions may have the same depth as other portions of the slots or may have different depths. Providing rounded, enlarged lateral end portions may extend the lifetime of the helmet and/or allow the helmet to absorb more impacts without fracturing than if the rounded lateral end portions were not included.

The number and position of the slots 218 in helmet 200 is slightly different than the number and position of slots 118 in helmet 100. In the exemplary embodiment shown in FIG. 2, there are two slots disposed within a crown portion 208, two slots disposed within a front portion 210, two slots disposed within a right side portion 214, and four slots disposed within a rear portion 216. Each slot within the plurality of slots 218 is disposed adjacent to and generally parallel to at least one other slot, thereby defining an energy absorbing beam portion 226 between the adjacent parallel slots. Many other arrangements, including numbers and positions of slots, are possible aside from those shown in FIGS. 1 and 2.

The various pluralities of slots disposed within the corresponding portions of the shell need not all be the same. That is, the plurality of slots need not be uniform across a shell. Any or all of the length of a slot, the width of the slot, the position of the slot, and the distance between adjacent parallel slots can be different for different slots. This variability may facilitate variability in the energy absorbing properties of the shell across the helmet. That is, the different portions of the helmet may be designed or engineered to absorb different amounts of energy. This may be advantageous as different portions of a football helmet may be subjected to different amounts and kinds of forces.

Example 3

Figure 3:
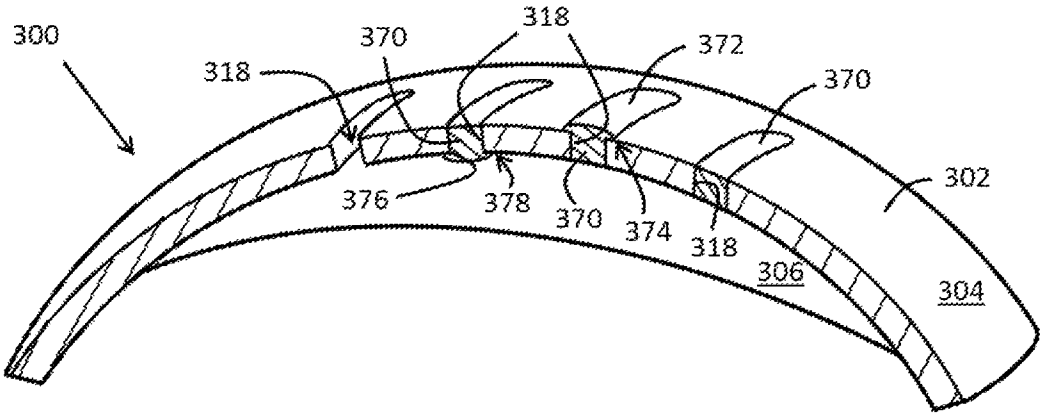
FIG. 3 is a sectional view of a portion of still another exemplary embodiment of an outer shell of a football helmet, showing slots which extend entirely through the shell and various types of infill for the slots, according to aspects of the present teachings.

This example describes an illustrative football helmet including a plurality of slots formed in an outer shell of the helmet that extend completely through the shell, according to aspects of the present teachings; see FIG. 3.

FIG. 3 is a sectional view of a portion of another exemplary embodiment of a football helmet, generally indicated at 300. Helmet 300 may have many similarities with helmets 100 and 200 described above, and the discussion of various features and benefits of helmets 100 and 200 will not be repeated in their entirety. Similar components and features of helmet 300, helmet 200, and helmet 100 are numbered accordingly.

Helmet 300 includes a one-piece outer shell 302 defining an exterior 304 and an interior 306. Helmet 300 also includes a plurality of slots 318 formed in the shell and extending entirely through the shell. In other words, each of slots 318 extends from the exterior 304 of the shell to the interior 306. The sectional view of FIG. 3 has been chosen to intersect several slots 318, illustrating that the slots extend entirely through the shell. Also as FIG. 3 depicts, one or more of slots 318 may be filled with a filling material 370, such as an elastopolymer. In some cases, for example, filling material 370 may be silicon. However, any resilient, durable material may be suitable. Material 370 may reduce the ingress of elements such as rain, mud, wind, and other external elements to the interior of the helmet. The filling material may also improve the deflection properties of the helmet, as objects sliding across the exterior 304 of the helmet may be less likely to catch on a slot if the slot is filled with material.

When used, filling material 370 may be disposed within, above and/or below a particular slot 318. For example, the right-most slot 318 in FIG. 3 is depicted with filling material disposed within the slot and substantially flush with the inner and outer surfaces of the shell. The slot 318 disposed second from the right in FIG. 3 is depicted with filling material extending from the bottom or inner surface 378 of the shell, through the slot, and with a portion 372 of the filling material extending slightly above the top or outer surface 374 of the shell, overlapping the outer surface at the edges of the slot. The slot 318 disposed second from the left in FIG. 3 is depicted with filling material 370 extending from the top or outer surface 374 of the shell, through the slot, and with a portion 376 of the filling material extending slightly below the bottom or inner surface 378 of the shell, overlapping the inner surface at the edges of the slot. Finally, the left-most slot 318 in FIG. 3 is depicted without any filling material at all. Any of these filling material configurations may be used, alone or in combination with each other, in the various slots of the helmet shell.

When provided, filling material 370 may be configured to inhibit water ingress into the slots. In some examples, overlapping material portions such as portions 372 and 376 may be formed unitarily with filling material 370 and may be considered an upper flange or a lower flange, respectively, of the material extending across the corresponding surface of the helmet. In some examples, regardless of whether a filling material 370 is provided, overlapping material portions such as portions 372 and 376 may be provided in the form of a separate waterproof or water-resistant tape or adhesive film, which can be applied to the outer surface 374 and/or the inner surface 378 of the shell.

As depicted in FIG. 3, according to the present teachings, any or all of the plurality of slots 118 in helmet 100 may extend entirely through shell 102. Any or all of slots 118 may include any or all of a filling material 370, an overlapping material portion 372, and/or an overlapping material portion 376. These possibilities also exist for the plurality of slots 218 in helmet 200, and for other embodiments.

Example 4

Figure 4:
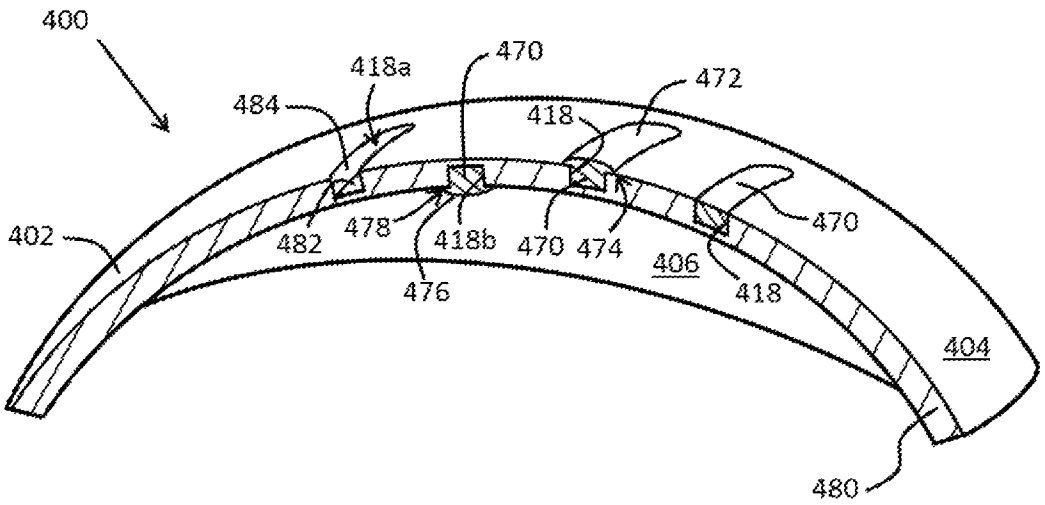
FIG. 4 is a sectional view of a portion of yet another exemplary embodiment of an outer shell of a football helmet, showing slots which extend partially through the shell and various types of infill for the slots, according to aspects of the present teachings.

This example describes yet another illustrative football helmet including a plurality of slots formed in an outer shell of the helmet and extending partially through the shell, according to aspects of the present teachings; see FIG. 4.

FIG. 4 is a schematic sectional view of yet another exemplary embodiment of a football helmet, generally indicated at 400. Helmet 400 may have many similarities with helmets 100, 200, and 300 described above, and the discussion of various features and benefits of helmets 100, 200, and 300 will not be repeated in their entirety. Similar components and features of helmets 400, 300, 200, and 100 are numbered accordingly.

Helmet 400 includes a one-piece outer shell 402 defining an exterior 404 and an interior 406, and a plurality of slots 418 formed in the shell and extending partially, but not entirely through the shell. One or more of the slots may extend from either one of the exterior 404 and the interior 406 of the shell into the bulk 480 of the shell 402, i.e., with the depth of the slot terminating within the thickness of the shell. For example, slot 418*a* shown in FIG. 4 extends from the exterior 404 of the shell into the bulk of the shell toward, but not all the way into, the interior 406 of the shell. Similarly, slot 418*b* shown in FIG. 4 extends from the interior 406 of the shell into the bulk of the shell toward, but not all the way to, the exterior 404 of the shell. Each partially penetrating slot defines a floor 482 and one or more sidewalls 484 extending between the floor and either the exterior or the interior of the shell.

Just as in the case of slots penetrating entirely through the helmet shell, one or more of partially penetrating slots 418 may be filled with a filling material 470, such as an elastopolymer material. This filling material may be flush with a surface of the shell, as in the case of the right-most slot 418 depicted in FIG. 4; the filling material may extend beyond and overlap the outer or inner surface of the shell, as in the case of the second from right and second from left slots 418 depicted in FIG. 4, respectively; or the filling material may not be provided at all, as in the case of the left-most slot depicted in FIG. 4. Furthermore, in some cases, overlapping material portions such as portions 472 and 476 may be formed unitarily with interior filling material portions 470, whereas in other cases, overlapping material portions may be provided separately, in the form of a tape or film.

Any or all of the plurality of slots 118 in helmets 100 and 200 depicted in FIGS. 1-2 may extend either entirely or partially through the helmet shell. Furthermore, any or all of slots 118 and 218 may include a filling material, a unitary overlapping material, or a separately provided tape or film covering all or a portion of the slot.

Embodiments of the present disclosure, including helmets 100, 200, 300, and 400, may have significant advantages over existing helmet designs that intend to absorb energy by using multiple layers and/or honeycomb-like structures. Both of these existing options add bulk and weight to the helmet, either of which may increase the risk for neck and other injuries. In contrast, embodiments of the present disclosure may improve the energy absorbing properties of a helmet while reducing the bulk and/or weight of the helmet by including less material, as compared to existing helmet designs.

Furthermore, the plurality of slots as disclosed herein provide a different function than ventilation holes included in other existing helmet designs. Ventilation holes in existing helmets are included strictly to facilitate the flow of air into and out of the helmet for increased comfort of the player. The outer shells of these helmets are constructed to retain their rigid properties in spite of the loss of material due to the ventilation holes. In contrast, the plurality of slots as described herein are included in order to alter the rigidity of the outer shell of the helmet, thereby allowing the outer shell to deform and absorb the energy of impacts to the helmet. The plurality of slots are included to increase the safety of the player, and any increases in player comfort due to ventilation through the slots are secondary benefits. Indeed, in cases where the slots only extend partially through the shell, the slots are filled with an elastopolymer material, or there is a material covering the slots to inhibit water ingress, there may be no added ventilation due to the slots.

Advantages, Features, Benefits

The different embodiments of the football helmets described herein provide several advantages over known solutions for absorbing energy due to impacts. For example, the illustrative embodiments of football helmets described herein allow for increased absorption of energy within the outer shell of a helmet, as compared to existing helmet designs. Additionally, and among other benefits, illustrative embodiments of the football helmets described herein allow the energy absorbing properties of the helmet to vary across the surface of the helmet. No known system or device can perform these functions, particularly while simultaneously decreasing the bulk and weight of a helmet. Thus, the illustrative embodiments described herein are particularly useful for reducing head and neck injuries related to football collisions. However, not all embodiments described herein provide the same advantages or the same degree of advantage.

Conclusion

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

What is claimed is:

1. A football helmet, comprising:

a one-piece, single layer outer shell defining an exterior and an interior, the shell including:

a crown portion defining an upper region of the shell;

a front portion extending generally forward and downward from the crown portion;

left and right side portions extending generally downward and laterally from the crown portion sufficiently to cover a respective left or right ear of a football player wearing the helmet;

a rear portion extending generally rearward and downward from the crown portion; and a plurality of slots formed in the shell, extending along the shell without reaching an edge of the shell and penetrating at least partially through the shell, wherein each slot is disposed adjacent to at least one other slot, each pair of adjacent slots defines an energy absorbing beam portion between the adjacent slots, and each beam portion is configured to flex and absorb energy to a greater extent than in the absence of the beam portion when the exterior of the shell is impacted from a normal direction;

wherein the plurality of slots includes at least two slots disposed within the crown portion of the shell, two slots disposed within the front portion of the shell, and two slots disposed within the rear portion of the shell; and wherein each slot of the plurality of slots is filled with an elastopolymer.

2. The helmet of claim 1, wherein the plurality of slots includes at least two slots disposed within the left side portion of the shell, and at least two slots disposed within the right side portion of the shell.

3. The helmet of claim 1, wherein each slot of the plurality of slots extends entirely through the shell.

4. The helmet of claim 1, further comprising a material extending across an outer surface of the shell proximate the slots which is configured to inhibit water ingress to the slots.

5. The helmet of claim 1, wherein each slot in a pair of adjacent slots is substantially parallel to the other slot in the pair.

6. The helmet of claim 5, wherein each slot in a pair of adjacent slots is discrete and non-continuous with the other slot in the pair.

7. A football helmet, comprising:

a one-piece, single layer outer shell defining an exterior and an interior, the shell including:

a crown portion defining an upper region of the shell;

a front portion extending generally forward and downward from the crown portion;

left and right side portions extending generally downward and laterally from the crown portion sufficiently to cover a respective left or right ear of a football player wearing the helmet;

a rear portion extending generally rearward and downward from the crown portion; and plurality of slots formed in the shell and extending along the shell, wherein each slot is disposed adjacent to at least one other slot, each pair of adjacent slots defines an energy absorbing beam portion between the adjacent slots, and each beam portion is configured to flex and absorb energy to a greater extent than in the absence of the beam portion when the exterior of the shell is impacted from a normal direction;

wherein the slots extend only partially through the shell.

8. The helmet of claim 7, further comprising a material extending across an outer surface of the shell proximate the slots which is configured to inhibit water ingress to the slots.

9. The helmet of claim 7, wherein each slot in a pair of adjacent slots is substantially parallel to the other slot in the pair.

10. The helmet of claim 9, wherein each slot in a pair of adjacent slots is discrete and non-continuous with the other slot in the pair.

11. The helmet of claim 7, wherein each of the plurality of slots has constant curvature along its length.

12. The helmet of claim 7, wherein each beam portion has a first beam end and a second beam end, with both the first and second beam ends continuous with portions of the shell outside of a region between the adjacent pair of slots.

13. A helmet configured to be worn by a football player while playing football, comprising:

a crown portion;

a front portion extending generally forward and downward from the crown portion;

left and right side portions extending generally downward and laterally from the crown portion;

a rear portion extending generally rearward and downward from the crown portion; and a plurality of pairs of adjacent slots penetrating at least partially through a single layer shell of the helmet, each pair of adjacent slots defining a beam portion configured to absorb energy to a greater extent than in the absence of the slots when an exterior of the helmet is impacted;

wherein each slot extends along the helmet without extending to an edge portion of the helmet; and wherein each slot extends only partially through the shell.

14. The helmet of claim 13, further comprising a material extending across an outer surface of the helmet proximate the slots which is configured to inhibit moisture ingress to the slots.

15. The helmet of claim 13, wherein each slot extends only partially through the shell from an exterior of the shell toward an interior of the shell.

16. The helmet of claim 13, wherein the adjacent slots of each pair of slots are substantially parallel.

17. The helmet of claim 13, wherein the plurality of pairs of slots includes a first plurality disposed in the crown portion, a second plurality disposed in the front portion, and third and fourth pluralities disposed in the left and right side portions, respectively.

* * * * *